US005531398A

United States Patent [19]

Krska

[11] Patent Number: 5,531,398

[45] Date of Patent: Jul. 2, 1996

[54] METHOD AND APPARATUS OF REMOVING A COIL OF MATERIAL FROM A MANDREL

[75] Inventor: Egon J. Krska, Downsview, Canada

[73] Assignee: Pro-Eco Limited, Oakville, Canada

[21] Appl. No.: 386,440

[22] Filed: Feb. 10, 1995

[51] Int. Cl.[6] ..... B65H 67/00

[52] U.S. Cl. ..... 242/533.7

[58] Field of Search ..... 242/533, 533.4, 242/533.5, 533.6, 533.7

[56] References Cited

U.S. PATENT DOCUMENTS

| | | | |
|---|---|---|---|
| 2,202,563 | 5/1940 | Mikaelson | 242/533.7 |
| 2,249,379 | 7/1941 | Ford et al. | 242/533.7 |
| 2,586,376 | 2/1952 | Picton | 242/533.7 |
| 2,988,349 | 6/1961 | Blackman et al. | 242/533.7 |
| 3,087,688 | 4/1963 | Anderson et al. | 242/533 |
| 4,211,375 | 7/1980 | Weiss et al. | 242/533.7 |

FOREIGN PATENT DOCUMENTS

| | | | |
|---|---|---|---|
| 1549885 | 8/1979 | United Kingdom | 242/533.7 |

*Primary Examiner*—John P. Darling
*Attorney, Agent, or Firm*—Donald E. Hewson

[57] ABSTRACT

A coil stripping apparatus that strips a coil of thin flexible material from a drum of coiling machine, comprises a non-rotating pusher plate slidably movable along the length of the drum, as powered by a hydraulically actuated motor, for effecting the transport of the coil along the drum. A stripper member having opposed first and second finger members, with the first and second finger members each having a base portion and a projecting portion, is rotatably mounted with respect to the non-rotating pusher plate for co-rotation with the drum about the longitudinal axis. The stripper member is in contact with one or the other of the first and second drive surfaces so as to be slidably movable along the length of the drum by the non-rotating pusher plate. The projecting portions are shaped and dimensioned to enter respective co-operating substantially longitudinally disposed first and second generally opposed slots in the drum, thereby to permit the stripper member to engage the entire radius of the coil at two generally opposed orientations and so as to permit the coil to be subsequently moved longitudinally along the drum and removed from the drum.

12 Claims, 4 Drawing Sheets

METHOD AND APPARATUS OF REMOVING A COIL OF MATERIAL FROM A MANDREL

FIELD OF THE INVENTION

This invention relates to machines for coiling large sheets of metal onto mandrel and more particularly to stripper plates used on such machines for removing the coiled sheets from the mandrel.

BACKGROUND OF THE INVENTION

Sheet metal is typically available in the form of relatively small sheets—perhaps four feet by eight feet or so—or alternatively in the form of much longer sheets—perhaps fifty feet to one hundred feet, or more, by perhaps two feet to eight feet wide—that have been coiled so as to form a relatively compact coil. These compact coils are each formed on a drum that is rotatably driven by large coiling machines. Typically, such large coiling machines have a generally horizontally disposed rotatably driven mandrel that receives the drum thereon in secured, yet removable, relation for concurrent rotation of the mandrel and drum. The mandrel is operatively connected at a first end thereof to the coiling machine in rotatably driven relation thereto. The second end of the mandrel is open so as to be adapted to receive the removable drum thereon, and also to accommodate the removal of a coil of sheet metal from the drum. After each coil of sheet metal material has been wound onto the drum on the mandrel, that coil must be subsequently removed from the drum. During such removal, the coil must be precluded from unwinding and also the layers of the coil must remain aligned with one another —that is to say that the edges of the layers of the coil must remain vertically aligned with one another. Further, the sheet metal material must not be damaged. Such removal must therefore be done very carefully so as to not damage the coil and so as to not deform the coil shape.

BRIEF DESCRIPTION OF THE DRAWINGS:

Embodiments of this invention will now be described by way of example in association with the accompanying drawings in which:

FIG. 4 is a top plan view, partially in section along section line 4—4, of the preferred embodiment of the coil stripping apparatus according to the present invention, as depicted in FIG. 3, and a portion of the coiling machine that the coil stripping apparatus is installed on;

FIG. 8 is a top plan view, partially in section along section line 8—8, of an alternative embodiment of the coil stripping apparatus according to the present invention, as depicted in FIG. 7, and a portion of the coiling machine that the coil stripping apparatus is installed on.

DESCRIPTION OF THE PRIOR ART

Figure 1:
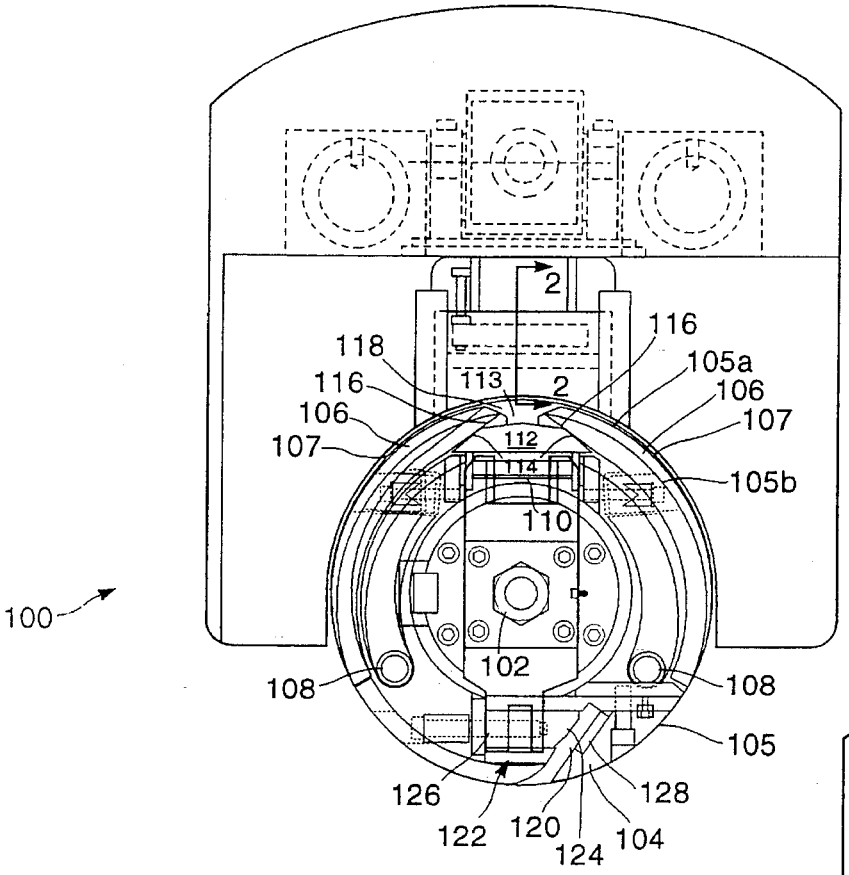
FIG. 1 is an end elevational view of a prior art coiling machine taken from the second end thereof.
Figure 2:
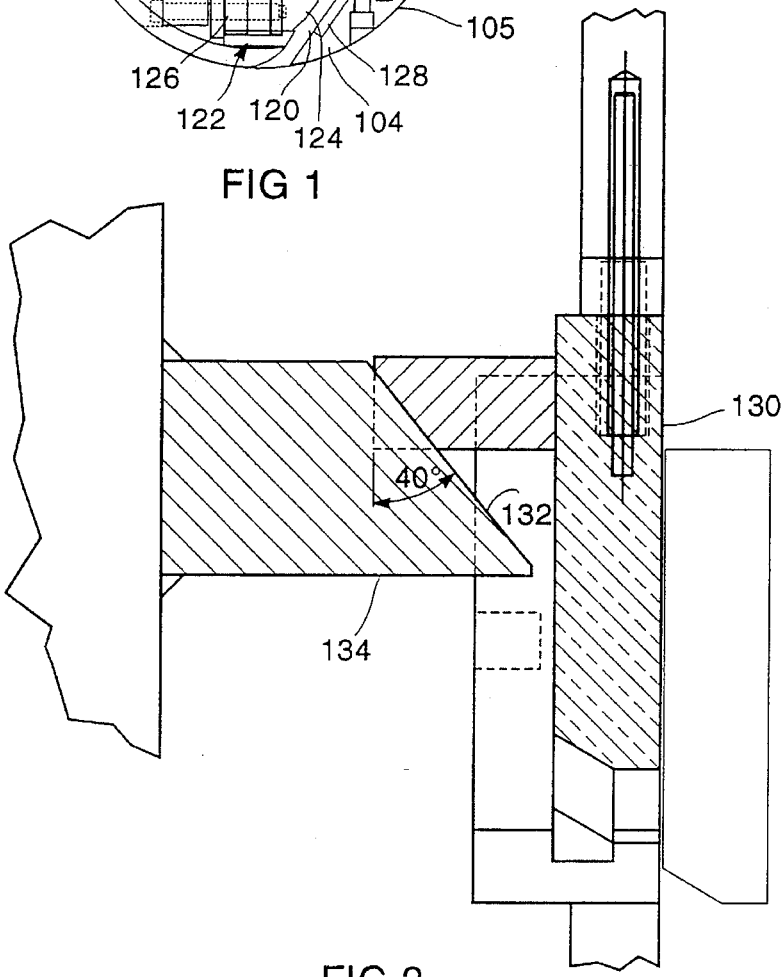
FIG. 2 is an enlarged side elevational view, partially in section along section line 2—2 of a portion of the prior art coiling machine of FIG. 1.
Figure 3:
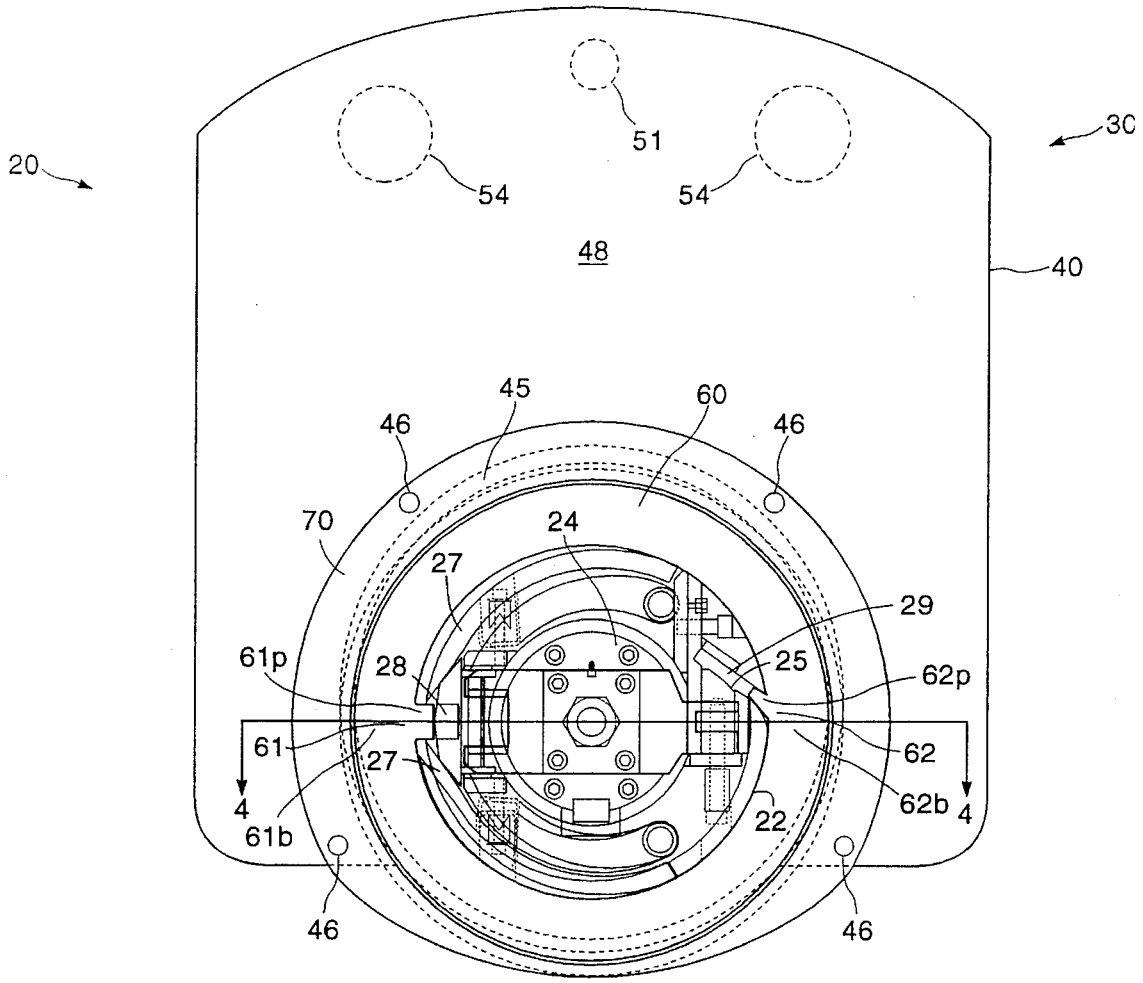
FIG. 3 is an end elevational view of the preferred embodiment of the coil stripping apparatus according to the present invention installed on a coiling machine, taken from the second end thereof.
Figure 4:
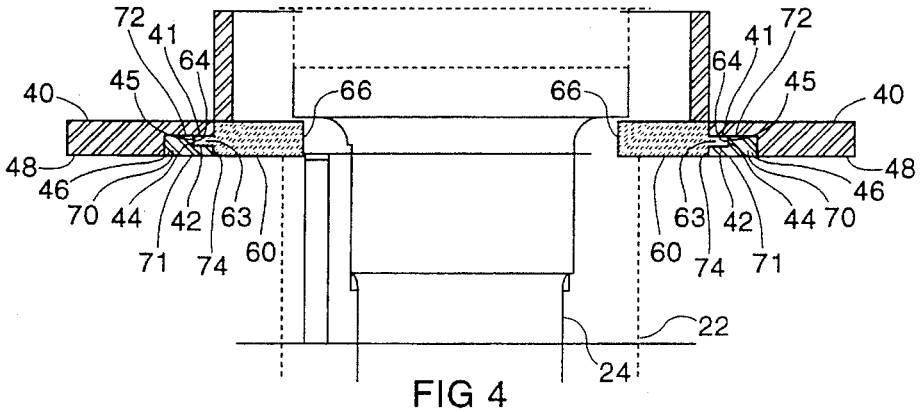
Figure 5:
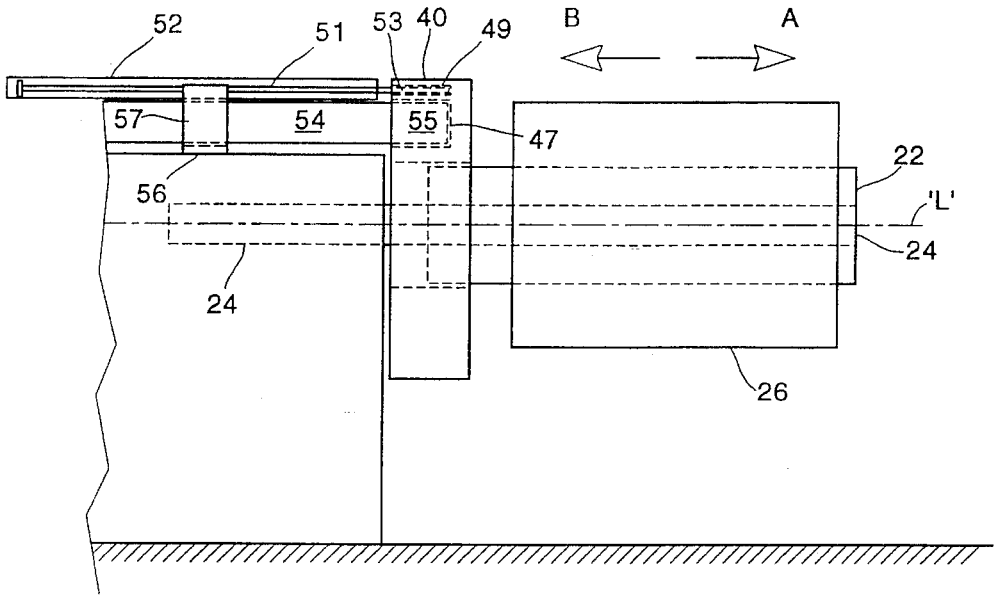
FIG. 5 is a side elevational view of the preferred embodiment of the coil stripping apparatus according to the present invention, as depicted in FIG. 3, with details omitted for clarity, with a coil of flexible sheet metal material having been coiled onto the drum.
Figure 6:
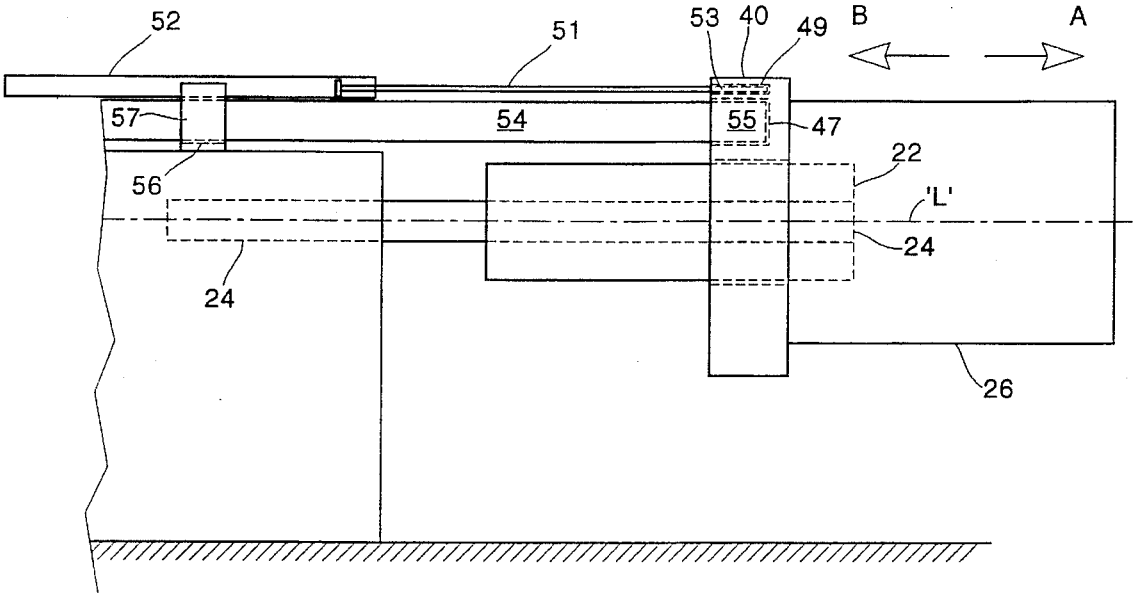
FIG. 6 is a side elevational view similar to FIG. 5, with the coil of flexible sheet metal material about to be removed therefrom.

In prior art coiling machines 100, as shown in FIGS. 1 and 2, the mandrel 102 is typically about four feet to eight feet long and about one foot in diameter. The removable, and therefore interchangeable, drums 104 typically have a diameter at its outer periphery 105 of about twenty inches to twenty-four inches, depending on the size of coil to be formed and the thickness of sheet metal to be coiled.

Irrespective of the outer diameter of the drum 104, the coil of sheet metal material wound around the drum 104 must be removed by sliding the coil of material off the drum 104 in the direction of the open end of the mandrel 102. In order to permit the coil of material to be removed in this manner from the drum 104, typical prior art drums 104 are selectively expandable and contractible between a full diameter and a reduced diameter. The full diameter—corresponding to the outer periphery **105*a* as shown in FIG. 1—is used when coiling a sheet of metal material onto the drum 104, and the reduced diameter—corresponding to the outer periphery 105*b* as shown in FIG. 1—is used when removing a coil of metal material from a drum 104**.

Indeed, the most common type of prior art drum is a collapsing-type of drum 104. Such collapsing type drums 104 are preferably circular in cross-section when at their full diameter, so as to permit a round coil of sheet metal material to be formed, and are typically not circular in cross-section when at their reduced diameter. Typically, this type of collapsing drum includes a pair of opposed peripheral flap members 106 that form a major portion of the outer periphery 105 of the drum 104. The outer peripheral surface 107 of the flap members 106 must be semi-circular in cross-section so as to cause the outer periphery **105*a* of the drum 104 to be generally circular in cross-section when at its full diameter. This is important so as to form a substantially round coil of sheet metal material as opposed to perhaps a slightly irregularly formed coil of sheet metal material. The flap members 106 are pivotally mounted on the drum 104 at pivot pins 108 :for concurrent pivotal movement between a closed position corresponding to the reduced diameter of the drum 104, and a spread position corresponding to the full diameter of the drum 104**.

A hydraulically operable actuation plunger 110 is mounted within the drum 104 so as to be slidably moveable between a retracted position and an extended position. The retracted position of the actuation plunger 110 corresponds to the closed position of the flap members 106; the extended position of the actuation plunger 110 corresponds to the spread position of the flap members 106. The actuation plunger 110 has a head portion 112 that has a semicircular outer peripheral surface 113 of the same radius as the outer peripheral surface of the flap members 106. A pair of opposed cam surfaces 114 are disposed at each edge of the head portion 112, which cam surfaces 114 each slidably engage a respective co-operating ramp surface 116 on a respective one of the flap members 106.

In use, when the actuation plunger 110 travels from its extended position to its retracted position, a retraction slot 118 is formed between the two flap members 106. Further, the cam surfaces 114 on the actuation plunger 110 retract along the ramp surfaces 116 of the two flap members 106 so as to permit the two flap members 106 to be moved by a biasing spring (not shown) to their closed position, thus causing the drum 104 to realize its reduced diameter. When the two flap members 106 are in their closed position, the retraction slot 118 is reduced marginally in size, but still remains. When the drum 104 is at its reduced diameter, a coil of sheet metal material may be slidably longitudinally removed from the drum 104. When the actuation plunger 110 travels from its retracted position to its extended position, the cam surfaces 114 on the actuation plunger 110 cause the two flap members 106 to be moved against the biasing spring (not shown) to their spread position, thus causing the drum 104 to realize its full diameter.

A material receiving slot 120 is located at the exterior of the drum 104, typically at the opposite side of the drum 104 to the actuation plunger 110. A clamping means 122 comprising a clamping head 124 mounted on a hydraulically operable driving piston 126, is operatively retained within the material receiving slot 120. The clamping head 124 is moveable between a clamping position and a release position. In the clamping position, the clamping head 124 enters the material receiving slot 120 so as to clamp an inserted end of a sheet of metal material to a stop member 128, so as to securely retain the end of the sheet metal material for subsequent coiling onto the drum 104. In the release position, the clamping head 124 is retracted so as to be :removed from the material receiving slot 120, to thereby release the sheet metal material therefrom. The clamping action of the clamping means 122 coincides with the drum 104 being expanded to its full diameter for the purpose of receiving a coil of sheet metal in coiled relation thereon.

In the above described prior art device, when the actuation plunger 110 is in its retracted position and when the clamping means 122 is in it release position, two co-operating substantially longitudinally disposed first and second generally opposed slots—namely the retraction slot 118 and the material receiving slot 120—are formed.

In operation, in order to coil a sheet of metal material onto a drum 104, an end of the sheet of metal material is inserted into the material receiving slot 120; the clamping head 124 moves to its clamping position so as to clamp the inserted end of the material in place in the material receiving slot 120; concurrently, the actuation plunger 110 forces the flap members 106 to their open position so as to cause the drum 104 to be at its expanded diameter. The sheet of metal material is then wound around the drum 104 so as to form a coil of sheet metal material. When the coil of sheet metal material that has been wound around the drum 104 is to be removed therefrom, the actuation plunger 110 is moved from its extended position to its retracted position so as to cause the drum 104 to go from its full diameter to its reduced diameter. A stripper member in the form of a hydraulically driven stripper plate 130 is first lowered to the outer periphery **105*b* of the drum 104 at its reduced diameter, as guided by a sloped cam surface 132 on a cam block 134, such that a curved lower edge 131 of the stripper plate 130 is juxtaposed to the outer periphery 105*b* of the drum 104, as shown in ghost outline in FIG. 2. The stripper plate 130 is then moved along the length of the drum 104 from the second base end to the first open end, so as to push the coil of sheet metal material off the drum 104**.

It frequently occurs that there are difficulties encountered during the removal of a coil of sheet material from this type of drum 104 in the manner described immediately above, for several reasons. It must first be understood that when the drum 104 is at its full diameter the curved lower edge 131 of the stripper plate 130 generally contacts the outer periphery **105*a* of the drum 104, since the curved lower edge 131 is of the same radius as the outer periphery 105*a* of the drum 104. However, when the drum 104 is at its reduced diameter, the outer periphery 105*a* of the drum 104 is not circular in cross-section, for two reasons. Firstly, the outer peripheral surface 107 of each of the flap members 106 is oriented such that the centre of radius of each is not concentric with the centre of radius of the curved lower edge 131 of the stripper plate 130. Secondly, there are two slots—namely the retraction slot 118 and the material receiving slot 120—at the periphery of the drum 104. Accordingly, since the outer periphery 105*b* of the drum 104 is not circular when the drum 104 is at its reduced diameter, the curved lower edge 131 of the stripper plate 130 generally is not concurrent with the outer periphery 105*b* of the drum 104** during the stripping of the coil therefrom.

Therefore, it very frequently occurs that the innermost layer of the coil of sheet metal material—which layer is relatively thin and is juxtaposed the drum 104—can fit between the outer periphery **105*b* of the drum 104 and the lower edge 131 of the stripper plate 130. Further, the leading end of the sheet of material that is in the material receiving slot 120 into the material receiving slot 120 and is therefore significantly below the level of the outer periphery 105*b* of the drum 104. Also, if the drum 104 stops rotating such that the retraction slot 118 is at the top thereof, the coil of sheet metal material tends to span tightly across the retraction slot 118** due to the weight of the coil.

Given the above, an unacceptably serious problem occurs during removal of the coil of sheet metal material from the drum 104. The innermost layer of the coil of the sheet of metal material is often passed over by the stripper plate 130, thus causing the coil of sheet metal material to be removed from the drum 104 in an uneven manner, or even to cause the leading end of the sheet metal material to become unevenly wedged, and therefore caught, within the material receiving slot 120 of the drum 104, thus hindering removal of the coil of flexible sheet metal material, and thus potentially causing damage to the sheet metal material.

Another reason for the occurrence of this problem is that the stripper plate 130 acts at only one locality on the drum 104, which tends to cause an even pushing of the coil of material along the drum 104, which may in turn lead to binding of the coil of sheet metal material on the drum 104, thus potentially causing damage to the sheet metal material.

SUMMARY OF THE INVENTION

In accordance with one aspect of the present invention, there is provided in a coiling machine for coiling elongate sheets of thin flexible material onto a drum, the drum being removably mounted on a selectively rotatable mandrel configured for rotation about a longitudinal axis, so as to form a coil of the material in a retained position on the drum, a coil stripping apparatus for stripping the coil from the drum. The coil stripping apparatus comprises a non-rotating pusher plate slidably movable along the length of the drum in opposed first and second opposed directions so as to provide displacement means for effecting the transport of the coil along the drum from the retained position to a removed position. The non-rotating pusher plate has opposed first and second drive surfaces, with the first drive surface generally facing the first direction and the second drive surface generally facing the second direction. A movement inducing means is operatively connected to the pusher plate to selectively move the pusher plate along the length of the drum. A stripper member has opposed first and second finger members, with the first and second finger members each having a base portion and a projecting portion. The base portions are retained with respect to the non-rotating pusher plate such that the stripper member is rotatably mounted with respect to the non-rotating pusher plate for co-rotation with the drum about the longitudinal axis, the stripper member being in contact with one or the other of the first and second drive surfaces so as to be slidably movable along the length of the drum by the non-rotating pusher plate. The projecting portions are shaped and dimensioned to enter respective co-operating substantially longitudinally disposed first and second generally opposed slots in the drum, thereby to permit the stripper member to engage the entire radius of the coil at two generally opposed orientations and so as to permit the coil to be subsequently moved longitudinally along the drum from the retained position to the removed position by the stripper member.

PURPOSES OF THE INVENTION

It is an object of the present invention to provide a stripper plate means that engages the innermost layer of the coil of sheet metal material on a drum for even and proper removal from the drum.

It is another object of the present invention to provide a stripper member that engages a coil of sheet metal material to be removed from a drum, where the engagement is in at least two generally opposed locations.

DETAILED DESCRIPTION OF THE PREFERRED EMBODIMENTS

Reference will now be made to FIGS. 3 through 6, which show a preferred embodiment of a coiling machine 20 that is used to coil elongate sheets of thin flexible sheet metal material onto a drum 22. The drum 22 is removably mounted on a selectively rotatable mandrel 24 and configured for rotation about a centrally disposed longitudinal axis "L". The mandrel 24 is securely retained by the main body 21 of the coiling machine 20. The selectively rotatable mandrel 24 is rotated so as-to thereby rotate the drum 22, so as to form a coil 26 of the sheet of thin flexible sheet metal material in a retained position on the drum 22.

The drum 22 is expandable and contractible between a full diameter and a reduced diameter, as discussed in detail in the background portion of this document. When the drum 22 is at its full diameter, the periphery 19 of the drum 22 is generally circular in cross-section. When the drum 22 is at its reduced diameter, the periphery 19 of the drum 22 is not circular in cross-section.

Once the coil 26 of the sheet metal material has been formed on the drum, it must be removed by way of a coil stripping apparatus 30. The coil stripping apparatus 30 provides for evenly distributed pushing of the coil 26 along the drum 22, from the second base end of the drum 22 to the first open end of the drum 22, by urging the coil 26 along the drum 22 without permitting any of the innermost layers of the coil 26 to become wedged between the coil stripping apparatus 30 and the drum 22—in other words, the coil 26 of thin flexible sheet metal material remains in its properly coiled form as it is pushed along, and eventually off, the drum 22 to a removed position.

The coil stripping apparatus 30 comprises a non-rotating pusher plate 40 that is slidably moveable along the length of the drum 22 in opposed first and second directions, as indicated by arrows "A" and "B", respectively. The non-rotating pusher plate 40 is powered by a movement inducing means in the form of a hydraulic cylinder 52. The hydraulic cylinder 52 is operatively connected to the non-rotating pusher plate 40 by means of an elongate rod member 51. The end 53 of the rod member 51 engages a bore hole 49 in the non-rotating pusher plate 40. The rod member 51 is securely retained in the non-rotating pusher plate 40 by way of an insert pin (not shown). A pair of guide rails 54 are used to guide the nonrotating pusher plate 40 along its path in said opposed first and second directions, as indicated by arrows "A" and "B", which guide rails 54 are securely fitted at their proximal ends 55 to bore holes 47 in the non-rotating pusher plate 40, and are securely retained by insert pins (not shown). The guide rails 54 are received in intimate sliding engagement within respective cooperating apertures 56 in guide brackets 57. The hydraulic cylinder 52 selectively moves the pusher plate 40 along the length of the drum 22. Accordingly, the non-rotatable pusher plate 40 provides displacement means for effecting the transport of the coil 26 along the drum 22 from its retained position to a removed position whereat the coil 26 is no longer on the drum 22.

Securely attached in removable relation to the non-rotating pusher plate 40, by way of threaded fasteners 46, is a securing plate 70 having a circular aperture 74 centrally located therein. Once secured to the non-rotating pusher plate 40, the securing plate 70 in essence becomes part of the non-rotating pusher plate 40. A first side surface 71 on the securing plate 70 faces outwardly so as to be generally coplanar with the front surface 48 of the non-rotating pusher plate 40. A second side surface 72 on the securing plate 70 forms the second drive surface 42 of the non-rotating pusher plate 40. An annular receiving channel 44 is defined between the first drive surface 41 and a peripheral outer wall 45 on the non-rotating pusher plate 40 and the second drive surface 42 on the securing plate 70 and the non-rotating pusher plate 40. The peripheral outer wall 45 adjoins the first and second guide surfaces 41 and 42.

The non-rotating pusher plate 40 has opposed first and second drive surfaces 41 and 42. The first drive surface 41 generally faces the aforesaid first direction as indicated by arrow "A", and the second drive surface 42 generally faces the aforesaid second direction as indicated by arrow "B".

An annular receiving channel 44 is defined by the opposed first and second drive surfaces 41 and 42 so as to be therebetween an peripheral outer wall 45 formed in the nonrotating pusher plate forms the perimeter of the annular receiving channel.

A stripper member 60 having a generally centrally disposed peripheral flange 63 with a circular perimeter 64, and a generally circular centrally disposed drum receiving aperture 66 therein, is rotatably mounted with respect to the non-rotating pusher plate 40 with the peripheral flange 63 being retained within the annular receiving channel 44, for co-rotation with the drum 22 about the longitudinal axis "L", as will be described in greater detail subsequently. The diameter of the generally circular centrally disposed drum receiving aperture 66 is very slightly greater than the overall diameter of the drum 22 at its full diameter. The height "H" of the stripper member 60 is defined as the distance between the drum receiving aperture 66 and the circular perimeter 64. The stripper member 60 has first and second finger members 61 and 62, with the first and second finger members 61 and 62 each having a respective base portion **61*b*, 62*b*, and a respective projecting portion 61***p*, 62*p*. In the preferred embodiment, the base portions 61*b*, 62*b* of the opposed first and second finger members 61 and 62, are joined one to the other so as to form a stripper member 60 having one integral base portion 67, which base portion 67 is annular in shape, with the perimeter thereof being defined by the aforesaid circular perimeter 64. The peripheral flange 63 extends outwardly from the base portion 67 of the stripper member 60 so as to be retained within the annular receiving channel 44, between the opposed first and second drive surfaces 41 and 42. The stripper member 60 is thereby rotatably mounted on the non-rotating pusher plate 40.

In use, the stripper member 60 is in contact with one or the other of the opposed first and second drive surfaces 41 and 42 so as to be slidably moveable along the length of the drum 22—in one of said opposed first and second directions "A" and "B" at a time—so that the stripper member 60 is slidably moveable along the length of the drum 22 by the nonrotating pusher plate 40.

The projecting portions 61*p*, 62*p* are shaped and dimensioned to enter respective co-operating substantially longitudinally disposed first and second generally opposed slots 28 and 29 in the drum. The slot 28 is a retraction slot that is produced when the two flap members 27 of the drum are moved to their closed position and the actuation plunger is moved to its retracted position. The slot 29 is a material receiving slot that is used to receive the leading end of the sheet of thin flexible sheet metal material. In use, the leading end of the sheet of thin flexible material sheet metal is clamped in place in the material receiving slot 29 by a clamping head 25.

In use, the projecting portions 61*p*, 62*p* project radially inwardly beyond the level of the perimeter 19 of the drum 22, even when the drum 22 is at its reduced diameter. The projecting portion 61*p* enters the retraction slot 28 while the projecting portion 62*p* enters the material receiving slot 29 so as to project below the lowest level of the innermost layer of material that is juxtaposed the drum 22. In this manner, the finger members 61 and 62 of the stripper member 60, along with the base portion 67 of the stripper member 60, ensure that all of the layers of the coil 26 of thin flexible sheet metal material are contacted, thereby to permit the stripper member 60 to engage portions of the entire radius of the coil 26 at two generally opposed orientations, and so as to permit the coil 26 to be subsequently moved by the stripper member 60 longitudinally along the drum 22 from its retained position to its removed position, thus removing the coil 26 from the drum 22, without deforming or damaging the coil 26, or without having the leading end of the coil catch beneath the stripper member 60 in the material receiving slot 29.

The coil stripping apparatus of the present invention, as described above, is adaptable for use with drums of various diameters. The stripper member is of appropriate overall diameter to be used in conjunction with a drum having a diameter of, for example, twenty-four inches. The stripper member remains with this particular drum, even when the drum is removed from the rotatable mandrel of the coiling machine. When a drum of a smaller diameter (e.g. twenty inches) is used, an appropriately sized stripper member is used. Such as stripper member would have an overall diameter such that the peripheral flange thereof is rotatably received and retained within the annular receiving channel of the non-rotating pusher plate. Further, the diameter of the drum receiving aperture in the stripper member would be very alightly greater than twenty inches. The height of such a stripper member would be two inches greater than the height of a stripper member for a twenty-four inch diameter drum.

Figure 7:
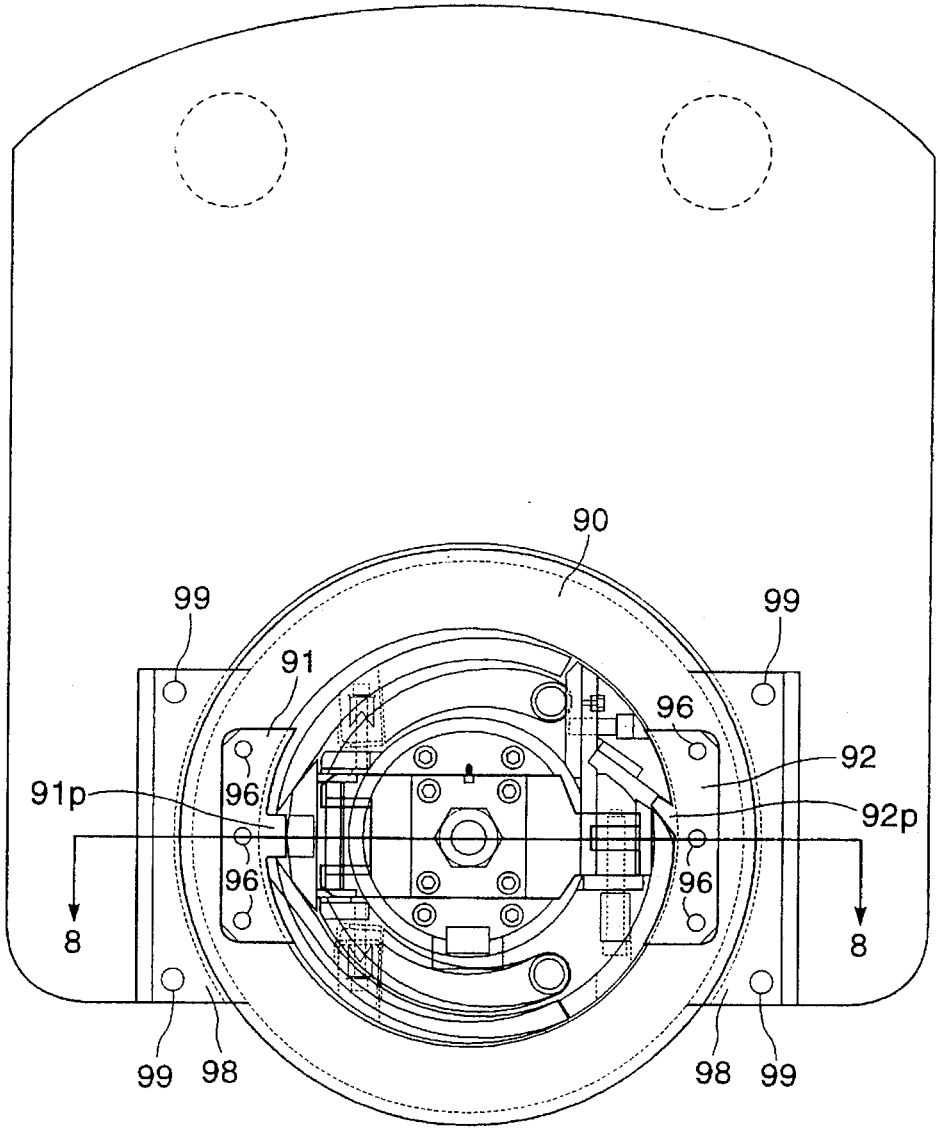
FIG. 7 is an end elevational view of an alternative embodiment of the coil stripping apparatus according to the present invention installed on a coiling machine, taken from the second end thereof.
Figure 8:
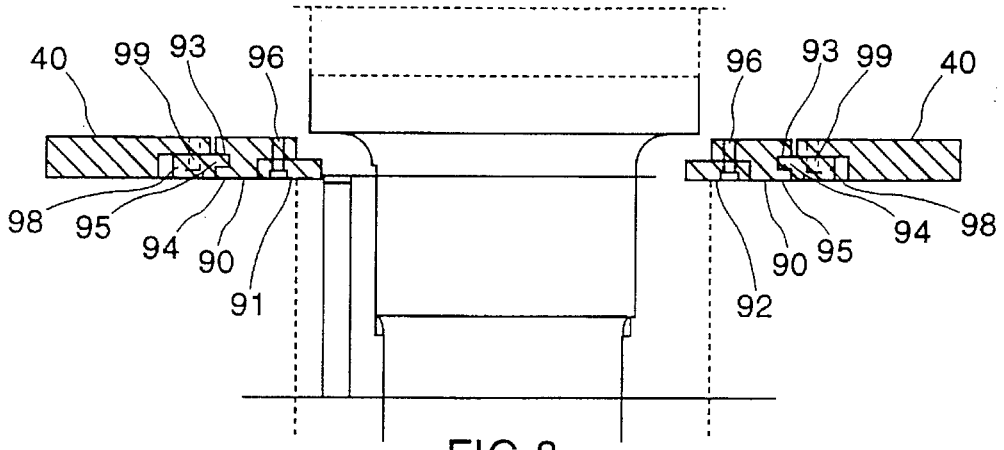

In an alternative embodiment of the present invention, as shown in FIGS. 7 and 8, the stripper member 90 is rotatably mounted with respect to the non-rotating pusher plate 40. The stripper member 90 has projecting portions 91*p* and 92*p* of first and second finger members 91 and 92, respectively, that are removably connected to the base portion 94, by way of threaded fasteners 96. In this manner, the projecting portions 91*p* and 92*p* are readily changeable in the event of breakage, and are readily interchangeable for projecting portions of alternative size and shape. Further, in this alternative embodiment, a pair of removable opposed sizing plates 98 is connected to the non-rotating pusher plate 40 by means of threaded fasteners 99. The removable opposed sizing plates 98 allow for various diameters of stripper members to be used, with the stripper member 90 be of the maximum diameter receivable. It is also taught in this embodiment to have a peripherally disposed channel 93 in the stripper member 90 and a co-operating flange member 95 in the opposed sizing plates 98 and the nonrotating pusher plate 93.

Other modifications and alterations may be used in the design and manufacture of the apparatus of the present invention without departing from the spirit and scope of the accompanying claims.

What is claimed is:

1. In a coiling machine for coiling elongate sheets of thin flexible material onto a drum, said drum being removably mounted on a selectively rotatable mandrel configured for rotation about a longitudinal axis, so as to form a coil of said material in a retained position on said drum, a coil stripping apparatus for stripping said coil from said drum, said coil stripping apparatus comprising:

a non-rotating pusher plate slidably movable along the length of said drum in opposed first and second directions so as to provide displacement means for effecting the transport of said coil along said drum from said retained position to a removed position, said non-rotating pusher plate having opposed first and second drive surfaces, with said first drive surface generally facing said first direction and said second drive surface generally facing said second direction;

movement inducing means operatively connected to said pusher plate to selectively move said pusher plate along the length of said drum;

a stripper member having opposed first and second finger members, with said first and second finger members each having a base portion and a projecting portion;

wherein said base portions are retained with respect to said non-rotating pusher plate such that said stripper member is rotatably mounted with respect to said non-rotating pusher plate for co-rotation with said drum about said longitudinal axis, said stripper member being in contact with one or the other of said opposed first and second drive surfaces so as to be slidably movable along the length of said drum by said non-rotating pusher plate; and wherein said projecting portions are shaped and dimensioned to enter respective co-operating substantially longitudinally disposed first and second generally opposed slots in said drum, thereby to permit said stripper member to engage the entire radius of said coil at two generally opposed orientations and so as to permit said coil to be subsequently moved by said stripper member longitudinally along said drum from said retained position to said removed position.

2. The coil stripping apparatus of claim 1, wherein said stripper member is rotatably mounted on said non-rotating pusher plate.

3. The coil stripping apparatus of claim 1, wherein said base portions of said stripper member are shaped and dimensioned so as to be received and retained within an annular receiving channel in said non-rotating pusher plate, with said annular receiving channel being defined between said first and second drive surfaces and a peripheral outer wall adjoining said first and second drive surfaces.

4. The coil stripping apparatus of claim 3, further comprising a securing plate securely attached in removable relation to said non-rotating pusher plate, wherein said annular receiving channel is formed between said securing plate and said non-rotating pusher plate.

5. The coil stripping apparatus of claim 3, wherein said stripper member further comprises a third finger member having a base portion and a projecting portion, with said base portion being shaped and dimensioned to be retained within said annular receiving channel and said projecting portion of said third finger member being shaped and dimensioned to enter a co-operating generally longitudinally disposed third slot in said drum, wherein said first, second and third slots are generally opposed one to another, thereby to permit said stripper member to engage the entire radius of said coil at three generally opposed orientations and so as to permit said coil to be subsequently moved longitudinally along said drum from said retained position to said removed position by said stripper member.

6. The coil stripping apparatus of claim 5, wherein said base portions of said opposed first and second finger members of said stripper member are joined one to the other so as to form a stripper member having one integral base portion.

7. The coil stripping apparatus of claim 6, wherein said integral base portion of said stripper member is annular in shape.

8. The coil stripping apparatus of claim 1, wherein said stripper member remains on said drum.

9. The coil stripping apparatus of claim 1 wherein said base portions of said opposed first and second finger members of said stripper member are joined one to the other so as to form a stripper member having one integral base portion.

10. The coil stripping apparatus of claim 9, wherein said integral base portion of said stripper member is annular in shape.

11. The coil stripping apparatus of claim 1, wherein said non-rotating pusher plate has a generally centrally disposed enlarged aperture and said drum passes through said enlarged aperture.

12. The coil stripping apparatus of claim 1, wherein said stripper member is made from metal material.

* * * * *